US010229797B2

(12) United States Patent
Yoshida et al.

(10) Patent No.: US 10,229,797 B2
(45) Date of Patent: Mar. 12, 2019

(54) PUSH SWITCH

(71) Applicant: MIYAMA ELECTRIC CO., LTD., Tokyo (JP)

(72) Inventors: Fumio Yoshida, Tokyo (JP); Hirotaka Oohori, Tokyo (JP); Kotaro Endo, Tokyo (JP); Akishige Kasegawa, Tokyo (JP)

(73) Assignee: MIYAMA ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/439,034

(22) Filed: Feb. 22, 2017

(65) Prior Publication Data

US 2017/0243706 A1 Aug. 24, 2017

(30) Foreign Application Priority Data

Feb. 23, 2016 (JP) ..... 2016-032338

(51) Int. Cl.
*H01H 13/58* (2006.01)
*H01H 13/14* (2006.01)
(Continued)

(52) U.S. Cl.
CPC ..... *H01H 13/14* (2013.01); *H01H 3/42* (2013.01); *H01H 13/10* (2013.01); *H01H 13/585* (2013.01); *H01H 2235/01* (2013.01)

(58) Field of Classification Search
CPC ..... H01H 13/585; H01H 3/42; H01H 2235/01
See application file for complete search history.

(56) References Cited

U.S. PATENT DOCUMENTS 4,506,124 A * 3/1985 Rose ..... H01H 13/58 200/528
5,145,059 A 9/1992 Park
(Continued)

FOREIGN PATENT DOCUMENTS

| | | |
|---|---|---|
| JP | 2004247102 | 9/2004 |
| JP | 2009-059578 | 3/2009 |
| JP | 2012089253 | 5/2012 |

OTHER PUBLICATIONS

Office Action Issued in co-pending Chinese Appl. Serial No. 201710086739.2; dated Apr. 4, 2018; China.
Japanese Office Action for JP2016-032338, dated Nov. 13, 2018.

*Primary Examiner* — Felix O Figueroa
(74) *Attorney, Agent, or Firm* — Steven M. Greenberg; Shutts & Bowen LLP

(57) ABSTRACT

A push switch includes: a hollow housing having an inner circumferential surface formed with a guide part; an operation button formed with a first ratchet tooth; a cam follower including a cam part, and a second ratchet tooth, and being movable up and down in an axial direction and rotatable in a circumferential direction; a first spring; an engagement piece engaged with the cam follower; a movable contact; a metallic contact member rotatable integrally with the cam follower; a fixed terminal including contacts to be switched by rotating the contact member; and a base on which the fixed terminal is fixed. The contact member defines a through hole at a rotation center of the contact member. The base includes a rotation axis part inserted in the through hole and serving as the rotation center of the contact member.

9 Claims, 12 Drawing Sheets

(51) Int. Cl.
*H01H 13/10* (2006.01)
*H01H 3/42* (2006.01)

(56) References Cited

U.S. PATENT DOCUMENTS 5,186,316 A * 2/1993 Mortun ..... H01H 13/585
200/276.1
6,191,376 B1 2/2001 Bartok
6,706,987 B1 * 3/2004 Yoo ..... H01H 13/04
200/523
7,030,331 B2 * 4/2006 Sasaki ..... H01H 13/585
200/341

* cited by examiner

PUSH SWITCH

CROSS-REFERENCE TO RELATED APPLICATIONS

This application claims priority under 35 U.S.C. § 119(a) to Japanese Patent Application Serial Number 2016-032338, filed Feb. 23, 2016 entitled "PUSH SWITCH," the entirety of which is incorporated herein by reference.

BACKGROUND OF THE INVENTION

Field of the Invention

The present invention relates to a push switch.

Description of Relevant Art

In a known push switch, pushing down an operation body makes a ring-shaped movable contact rotate relative to a fixed contact, thereby switching contacts (Patent document (1): Patent application publication laid-open No. 2009-59578)).

The push switch includes a cam follower to rotate stepwise by a push operation; a resinous operation member to rotate integrally with the cam follower; and an electrically energizable metallic movable contact to rotate integrally with the operation member. The movable contact is fixedly hung down from the operation member.

SUMMARY OF THE INVENTION

Meanwhile, this push switch has a continuous problem that the number of components is reduced.

The present invention is directed to a push switch including a smaller number of components.

An aspect of the invention provides the following push switch. The push switch includes: a hollow housing having an inner circumferential surface formed with a guide part including a rotation restriction part and a return restriction part; an operation button including a first ratchet tooth extending in a circumferential direction and being movable up and down in an axial direction; a cam follower including a cam part configured to be guided to the rotation restriction part and the return restriction part; and a second ratchet tooth engaged with the first ratchet tooth, the cam follower being movable up and down in the axial direction and rotatable in the circumferential direction; a first spring urging the cam follower to come close to the operation button in a return direction so as to mesh the first ratchet tooth and the second ratchet tooth with each other; a metallic contact member including an engagement part engaged with the cam follower, and a movable contact and being configured to rotate integrally with the cam follower; a fixed contact configured to contact with the movable contact and including contacts to be switched by rotating the contact member; and a base on which the fixed contact is fixed. When the operation button is pushed in a return allowance state under which the cam part is disposed at the rotation restriction part, the cam part moves from the rotation restriction part to the return restriction part. The cam follower and the cam contact member rotates before the cam part locks with the return restriction part to come into a return restriction state under which the cam follower is restricted from returning. When the operation button is pushed in the return restriction state, the cam part moves from the return restriction part to the rotation restriction part. The cam follower and the contact member rotate before the cam part comes into the return allowance state. The contact member has a rotation center and defines a through hole at the rotation center. The base includes a rotation axis part inserted in the through hole and serving as the rotation center of the contact member.

According to the aspect, the contact member functions as an operation member and a movable contact of the Patent Document (1), and the number of components of the push switch is reduced. The contact member preferably rotates about the rotation axis part of the base inserted through the through-hole of the contact member.

The rotation axis part may include an end inserted in the first spring constructed of a coil spring.

According to this element, the end of the rotation axis part is inserted in the first spring, thereby preventing the first spring from inclining.

The base includes an annular pedestal part projecting over the fixed contact toward the contact member.

According to this element, the annular pedestal part of the base prevents unnecessary short-circuit between the contact member and the fixed contact.

According to the aspect of the present invention, the push switch with a smaller number of components is provided.

BRIEF DESCRIPTION OF THE ACCOMPANYING DRAWINGS

DESCRIPTION OF THE EMBODIMENTS

The following description will be given of an embodiment of the present invention with reference to the FIGS. 1 through 12J. Herein, for clear description, "top, bottom, left, right, front, and rear" are set on FIG. 1 and the like. Meanwhile, these do not limit directions of a push switch 1 for use.

<<Construction of Push Switch>>

The push switch 1 is used as, for example, a switch to turn on or off a room lump for a vehicle.

Figure 1:
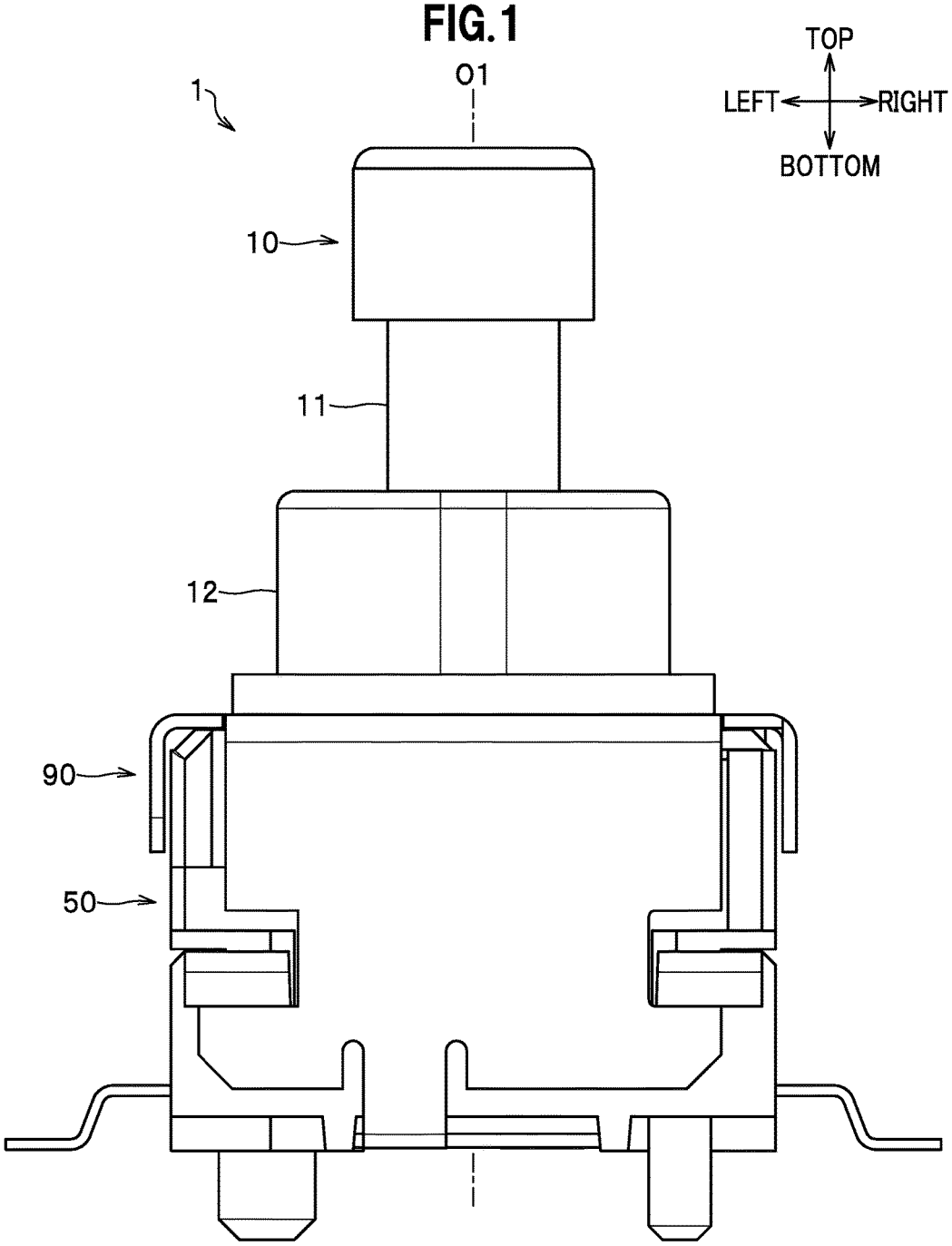
FIG. 1 is an elevation view of a push switch according to the present embodiment.
Figure 2:
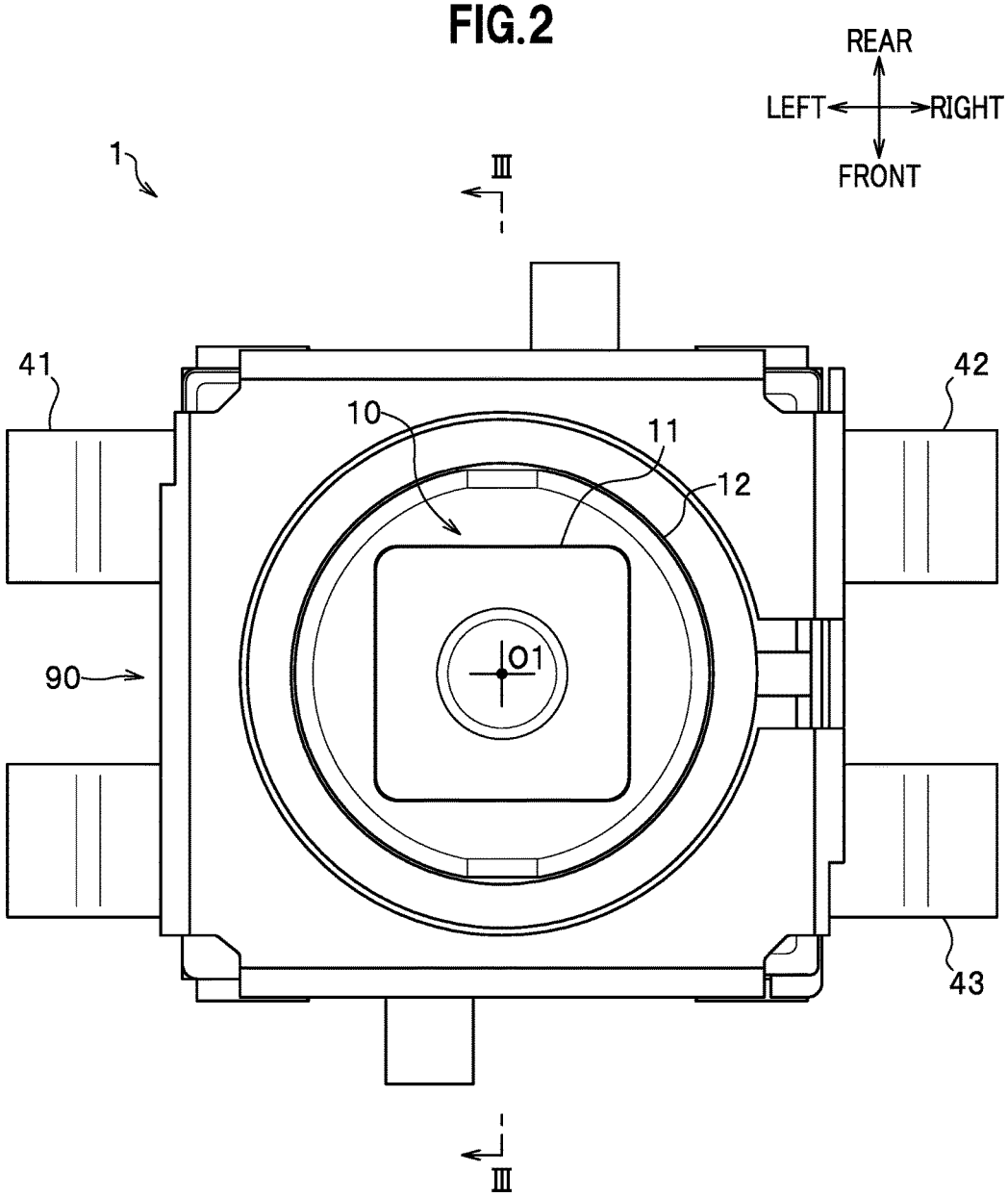
FIG. 2 is a plan view of the push switch of FIG. 1.
Figure 5:
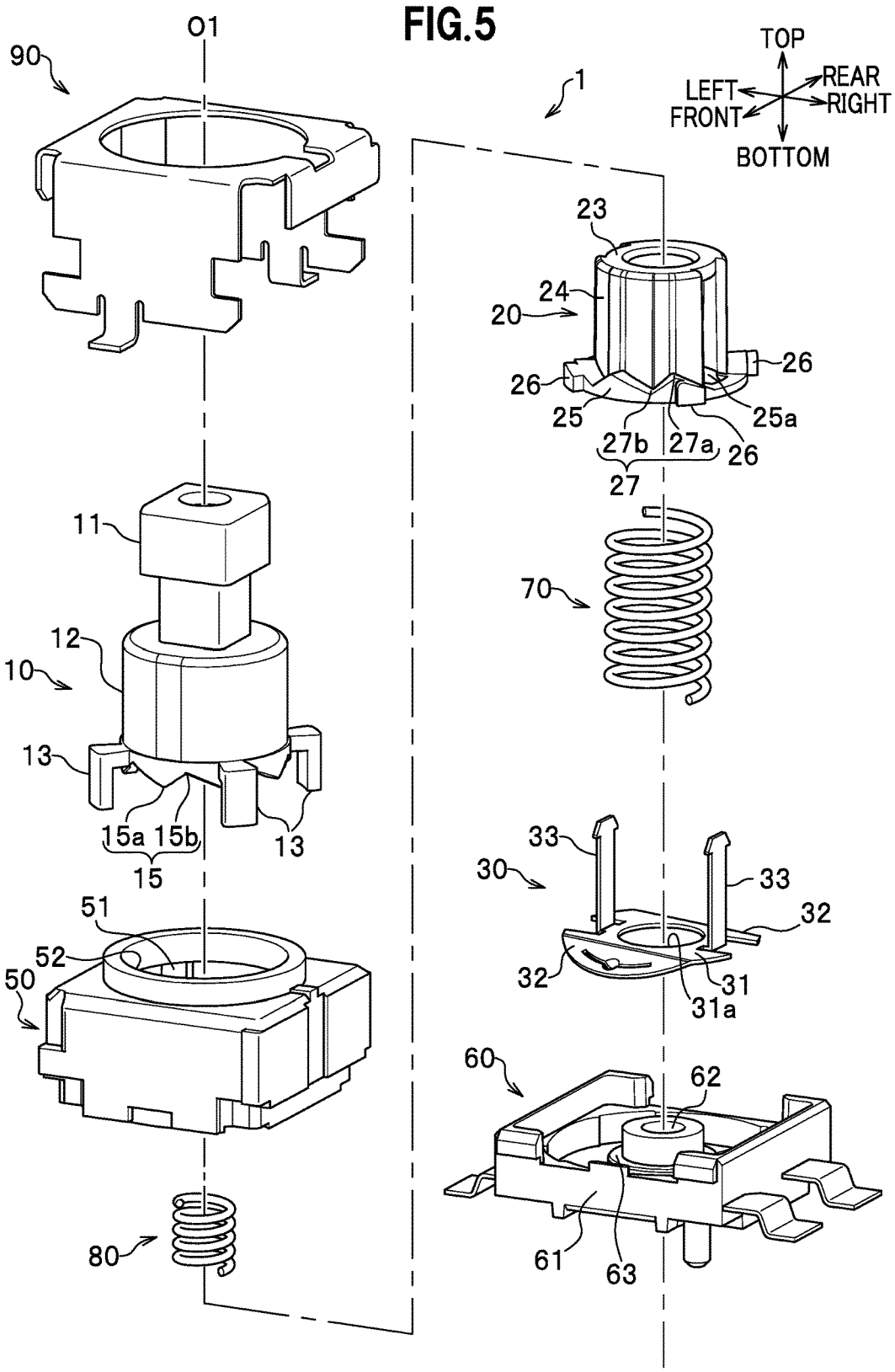
FIG. 5 is an exploded perspective view of the push switch of FIG. 1.

As illustrated in FIGS. 1 and 5, the push switch 1 includes an operation body or operation button 10, a cam follower 20, a contact member 30, a fixed terminal 40, a housing 50, a base 60, a first spring 70, a second spring 80, and a cover 90. The push switch 1 is a rotary switch, in which pushing the operation button 10 in the direction of axis O1 (axial direction or vertical direction) makes the contact member 30 rotate about the axis O1 relative to the fixed terminal 40 to switch contacts.

<Operation Button>

Figure 3:
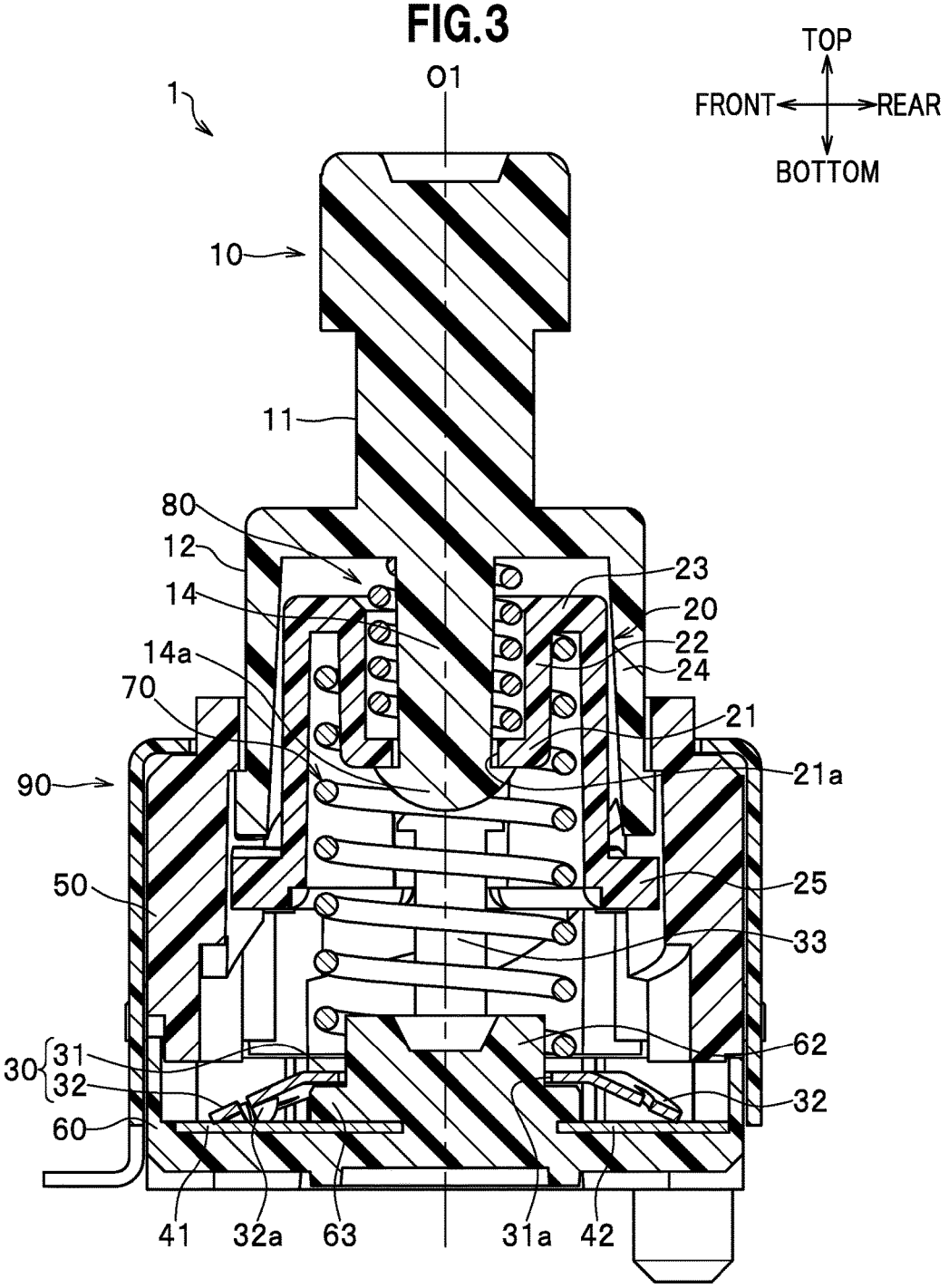
FIG. 3 is a vertical section of the push switch of FIG. 1, taken along III-III of FIG. 2.
Figure 6:
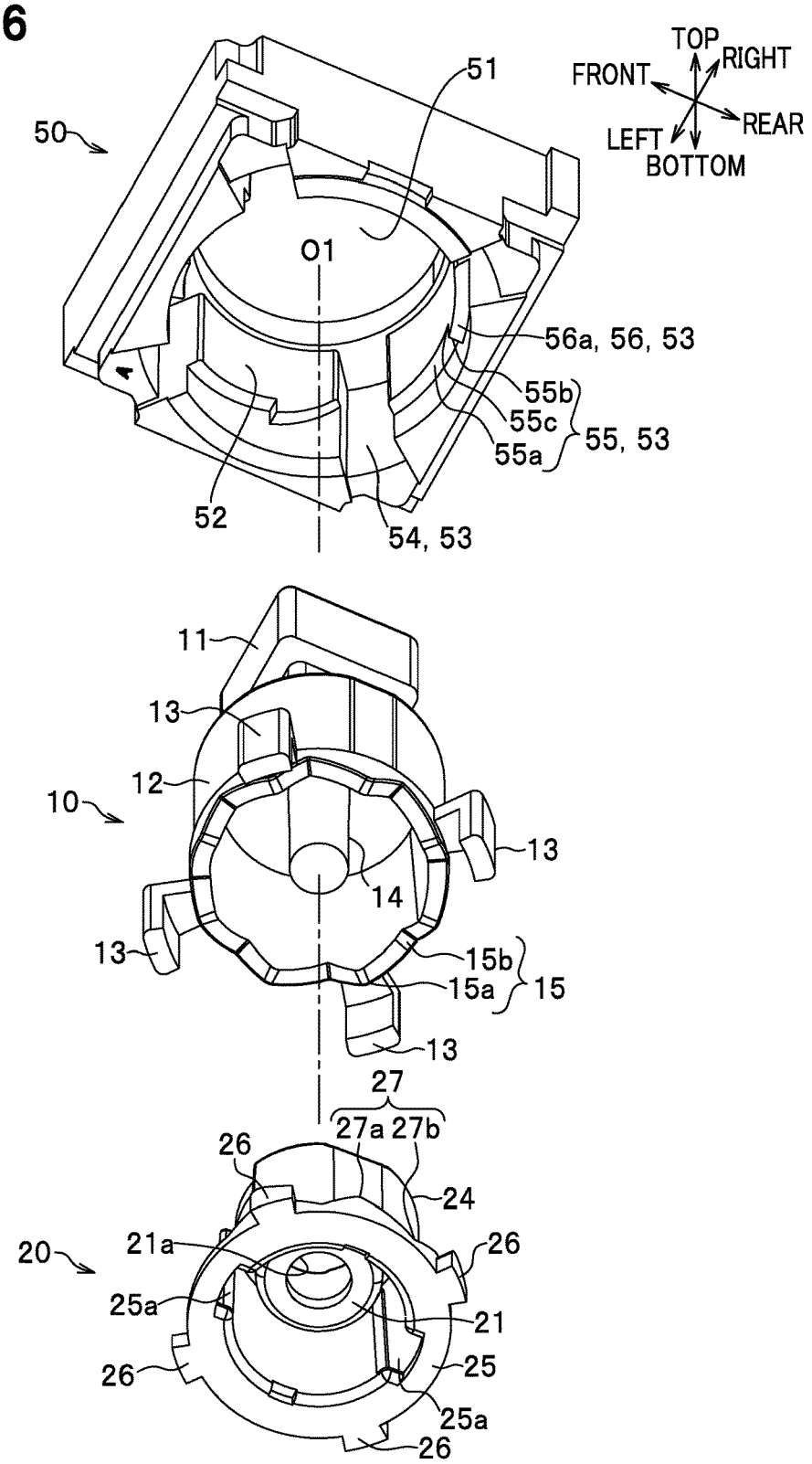
FIG. 6 is an exploded perspective view of the assembly of FIG. 4.

The operation button 10 is a component which an operator (driver etc.) directly operates, and is movable to the housing 50 in the axial direction (vertical direction). The operation button 10 is made of, for example, a thermoplastic rein. As illustrated in FIGS. 3, 5, and 6, the operation button 10 includes an operation part 11 in a quadrangular prism. The operation button includes a cylindrical part 12 extending radially outward from the lower end of the operation part 11 and extending downward with a large radius in a stepped manner. The operation button 10 includes four guided parts 13 extending from the lower end of the cylindrical part 12. The operation button 10 includes an axial part 14 extending downward from the bottom surface of the operation part 11 into the cylindrical part 12 along the axis O1.

The cylindrical part 12 has a lower end surface formed with a first ratchet tooth 15 extending in the circumferential direction. The first ratchet tooth 15 includes eight ridges 15*a* projecting downward, and eight troughs 15*b* recessed upward. The ridges 15*a* and the troughs 15*b* are arranged alternately in the circumferential direction (see FIGS. 5, 6, and 12A through 12J).

Figure 4:
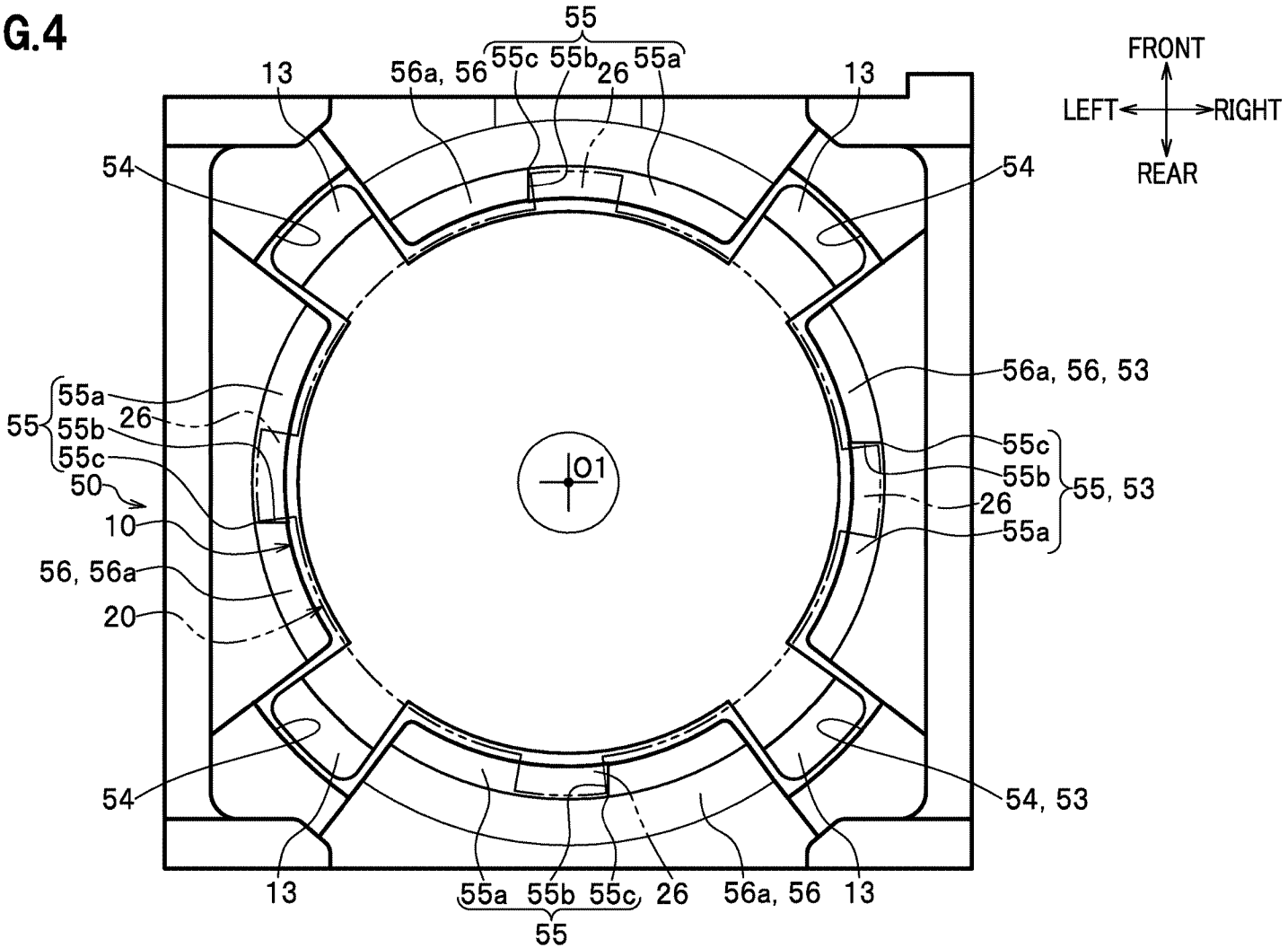
FIG. 4 is a bottom view of an assembly of an operation button, a cam follower, and a housing of the push switch of FIG. 1.

The four guided parts 13 are arranged at equal angular intervals (90 degrees interval) (see FIGS. 4, 5, and 6). Each guided part 13 extends radially outward from the lower end of the cylindrical part 12 and thereafter extends downward, representing an approximate L-shape. The guided parts 13 are axially slidably housed in the below-described rotation restriction part 54 (see FIGS. 4 and 6). Thereby, the operation button 10 is movable up and down relative to the housing 50 in the axial direction, meanwhile being incapable of rotating in the circumferential direction. The guided parts 13, projecting radially outward in this manner, lock with the housing 50 in the axial direction, and thereby prevent the operation button 10 from coming upward off the housing 50.

The lower end of the axis part 14 extends through the through-hole 21*a* of the cam follower 20 (see FIG. 3). The portion of the axis part 14, extending through the through-hole 21*a* or coming out of the through-hole 21*a*, is formed with a large diameter part 14*a* larger than the other portion. The large diameter part 14*a* locks with the bottom wall part 21 around the through-hole 21, and this locking prevents the axial part 14 (operation button 10) from coming upward off the cam follower 20. Note that the large diameter part 14*a* is formed by heating and caulking the lower end of the axis part 14 protruding downward from the through-hole 21*a*. Herein, the axis part 14 made of the thermoplastic resin is plastically deformable by heating.

<Cam Follower>

The cam follower 20 is a resinous double cylindrical member disposed in the housing 50 (see FIG. 3). The cam follower 20 is interlocked with the operation button 10 moving up-and-down to move up and down in the axial direction and rotate in the circumferential direction. As illustrated in FIGS. 4, 5 and 6, the cam follower 20 includes a ring-shaped bottom wall part 21 proximate to the center. The cam follower 20 includes an inner cylinder part 22 extending upward from the outer periphery of the bottom wall part 21. The cam follower 20 includes a ring-shaped top wall part 23 extending radially outward from the upper end of the inner cylinder part 22. The cam follower 20 includes an outer cylinder part 24 extending downward from the outer periphery of the top wall part 24. The cam follower 20 includes a ring-shaped flange part 25 extending radially outward from the lower end of the outer cylinder part 24. The cam follower 20 includes four cam parts 26 extending radially outward from the outer periphery of the flange part 25.

The bottom wall part 21 is formed at the center with a through hole 21*a* extending through the axis part 14.

The inner cylinder part 22 and the axis part 14 have a cylindrical space formed therebetween, in which a second spring 80 is housed. The outer cylinder part 24 and the inner cylinder part 22 have a cylindrical space formed therebetween, in which a first spring 70 is housed.

The flange part 25 is formed with a second ratchet tooth 27 on the top surface (see FIGS. 5 and 6). The second ratchet tooth 27 is opposed to the first ratchet tooth 15 in the axial direction, and urged by the first spring 70 to mesh with the first ratchet tooth 15. The second ratchet tooth 27 includes six ridges 27*a* projecting upward, and six troughs 27*b* recessed downward. The ridges 27*a* and the troughs 27*b* are arranged alternately in the circumferential direction.

The flange part 25 is formed with two engagement holes 25*a* extending through the flange part 25 in the axial direction (see FIGS. 5 and 6). The two engagement holes 25*a* are arranged on a single diameter line with the axis O1 intervening between the engagement holes 25*a*. The engagement holes 25*a* are holes in which engagement pieces 33 of the contact member 30 are inserted. Inserting the engagement pieces 33 in the engagement holes 25*a* makes the cam follower 20 and the contact member 30 engaged and spline coupled with each other in the circumferential direction. Thereby, the cam follower 20 and the contact member 30 integrally rotate about the axis O1

Note the engagement pieces 33 and the engagement holes 25*a* are movable relative to each other in the axial direction. This makes it possible for the cam follower 20 to move up and down relative to the contact member 30 in the axial direction.

The four cam parts 26 are arranged at equal angular intervals (90 degrees interval) in the circumferential direction (see FIGS. 4, 5, and 6). The cam parts 26 are guided by a guide part 53 as described below. The content of the guide part 53 will be described below.

<Contact Member>

Figure 7:
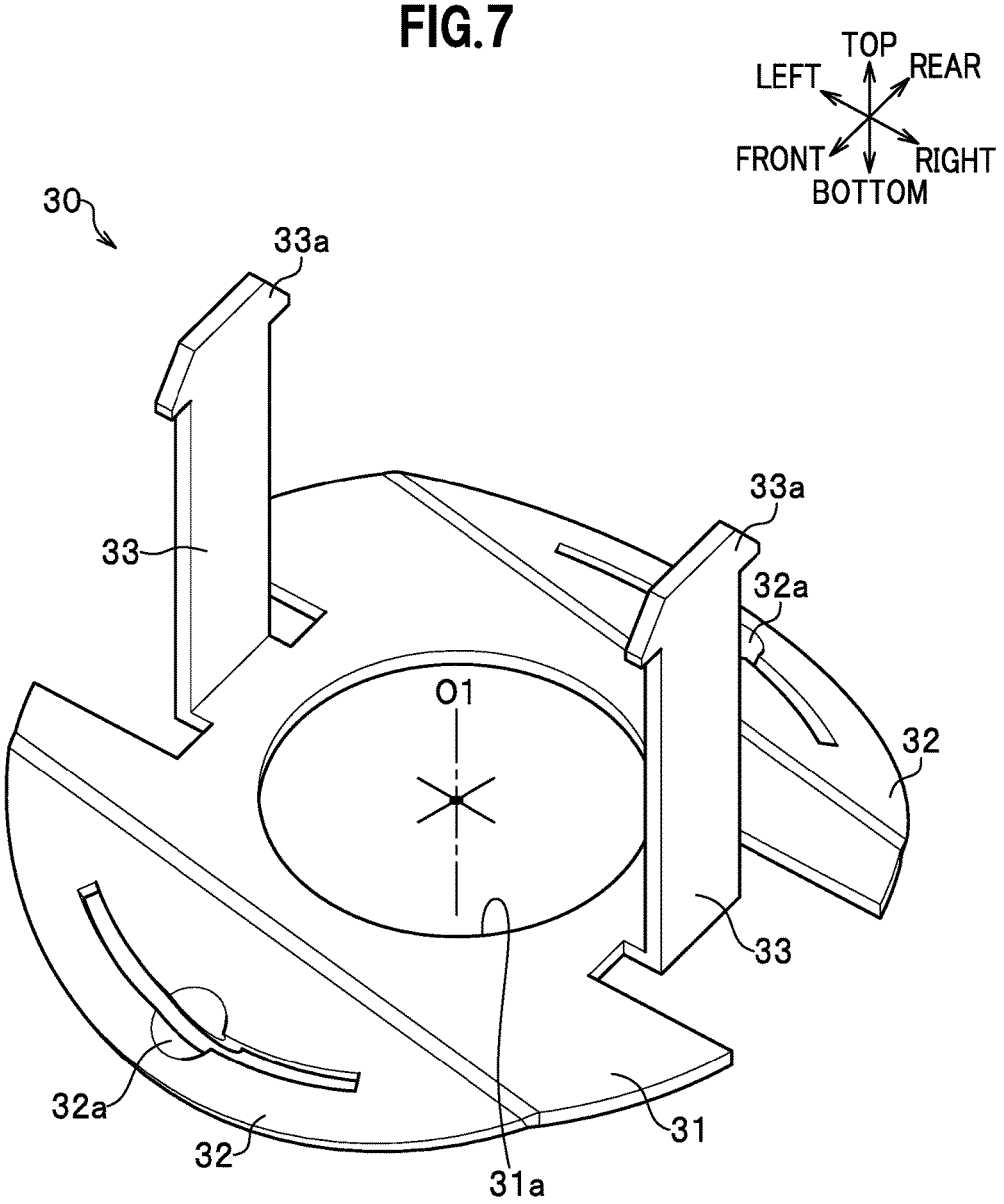
FIG. 7 is a perspective view of a contact member of FIG. 5.
Figure 8:
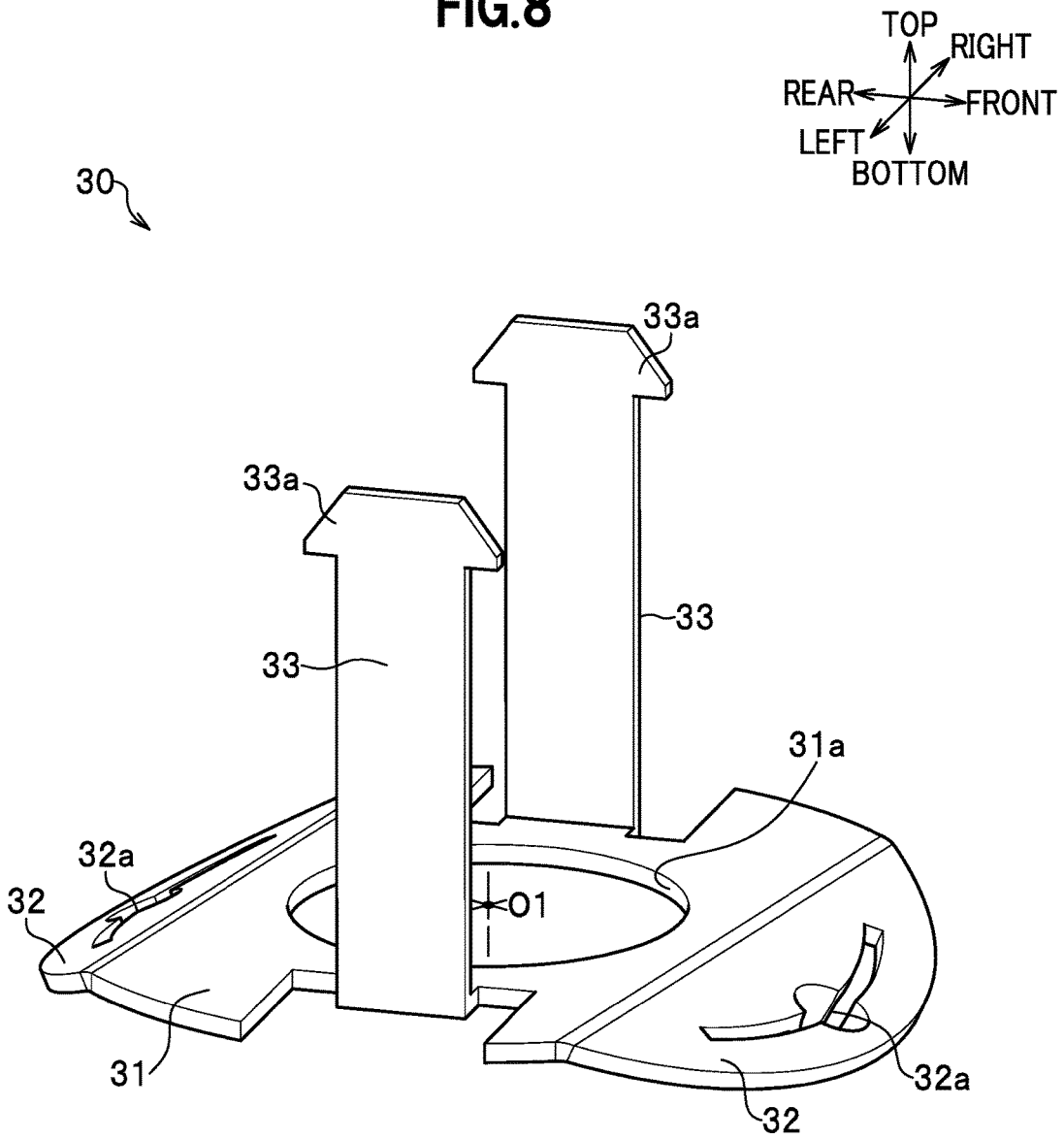
FIG. 8 is a perspective view of a contact member of FIG. 5.

The contact member 30 rotates relative to the fixed terminal 40 to switch contacts (see FIGS. 7 and 8). The contact member 30 functions as two parts of the operation member and the movable contact in the patent document (1), and reduces the number of components. The contact member 30 is an electrically energizable metal member formed by punching, bending, and pressing a thin plate of a metal.

The contact member 30 includes a base part 31, a pair of tongue pieces 32, and a pair of engagement pieces 33 (engagement parts).

The base part 31 is a plate-frame portion of a base, and formed with a through hole 31*a* on the axis O1 of the center. The through hole 31*a* is a hole through in which a rotation axis part 62 described below is inserted. The contact member 30 is configured to preferably rotate about the rotation axis part 62.

The two tongue pieces 32 are arranged opposite to each other with the base part 31 and the axis O1 intervening between the tongue pieces 32. Each tongue piece 32 in an approximate semicircle extends radially outward from the base part 31 and obliquely downward relative to the base part 31 at an obtuse angle. The obtuse angle of each tongue piece 32 and the base part 31 is designed such that the movable contacts 32*a* described below contact with the fixed terminal 40. The approximate center of each tongue piece 32 is formed with a movable contact 32*a* of a hemispherical shell projecting downward. Namely, two movable contacts 32*a* are arranged opposite to each other with the base part 31 and the axis O1 intervening between the movable contacts 32*a*. Namely, the two movable contacts 32*a* are arranged at an angular interval of 180 degrees about the axis O1 in the circumferential direction.

The two movable contacts 32*a* rotate stepwise about the axis O1 at every 45 degrees relative to the fixed terminal 40 so as to switch the contacts.

The two engagement pieces 33 are elongated plate pieces extending upward from base part 31. The engagement pieces 33 are arranged at the intermediate between the neighboring tongue pieces 32 in the circumferential direction and opposite to each other with the axis O1 intervening between the engagement pieces 33. Namely, the two tongue pieces 32 and the two engagement pieces 33 are alternately arranged at equal angular intervals (90 degrees interval) in the circumferential direction.

The two engagement pieces 33 are inserted in the two engagement holes 25*a* of the above described cam follower 20 respectively. Thereby, the cam follower 20 and the contact member 30 engage with each other in the circumferential direction, and integrally rotate about the axis O1. Each engagement piece 33 has an upper end formed with a wide part 33*a* of a larger width. The wide part 33*a* hooks on the flange part 25 around the engagement hole 25*a*, and is prevented from coming off the engagement hole 25*a*.

<Fixed Terminal>

Figure 9:
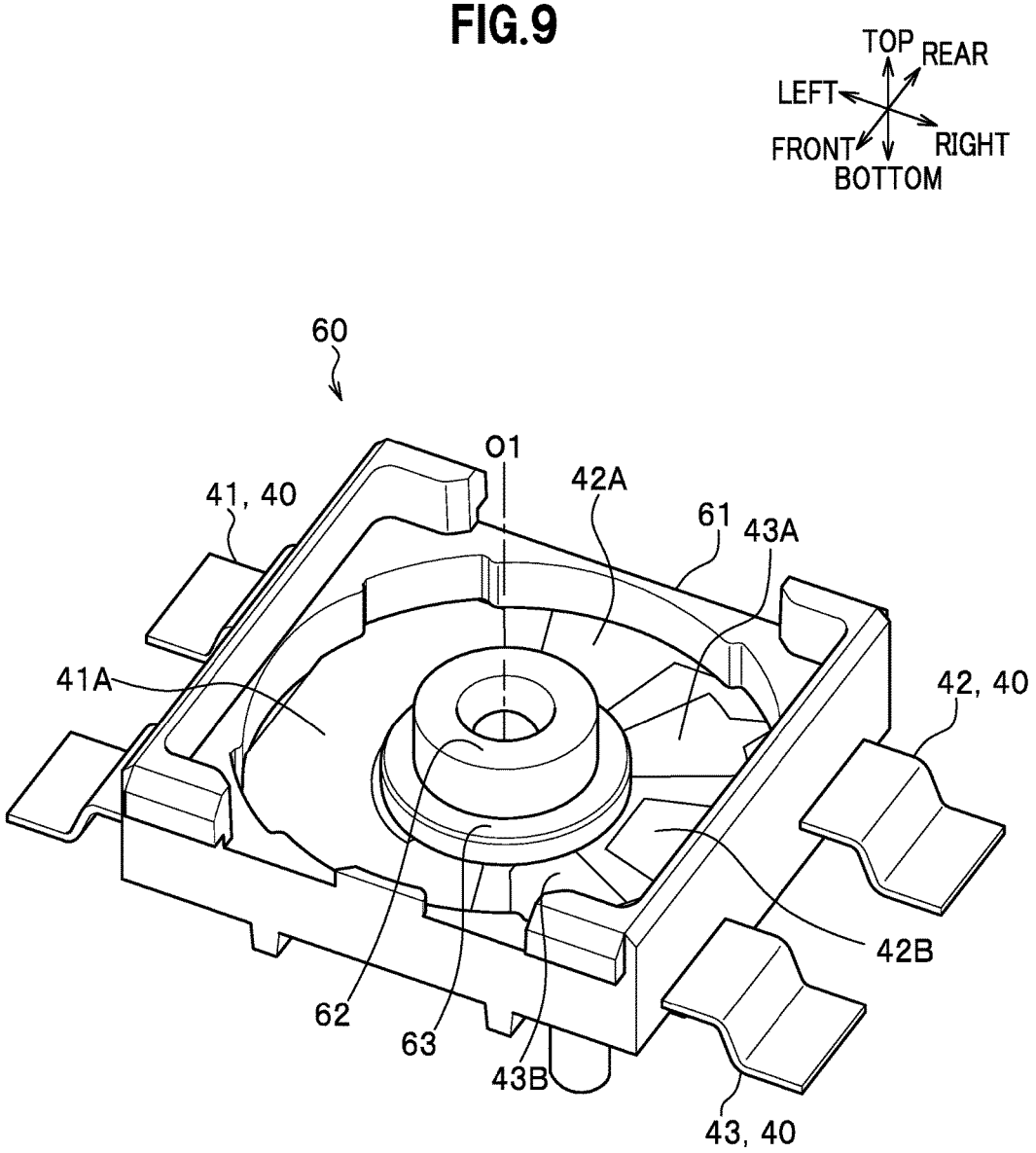
FIG. 9 is a perspective view of a base and a fixed contact of FIG. 5.
Figure 10:
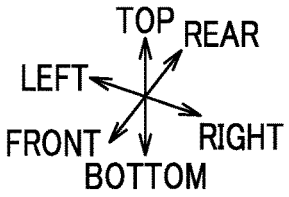
FIG. 10 is a perspective view of a base of FIG. 5.
Figure 10:
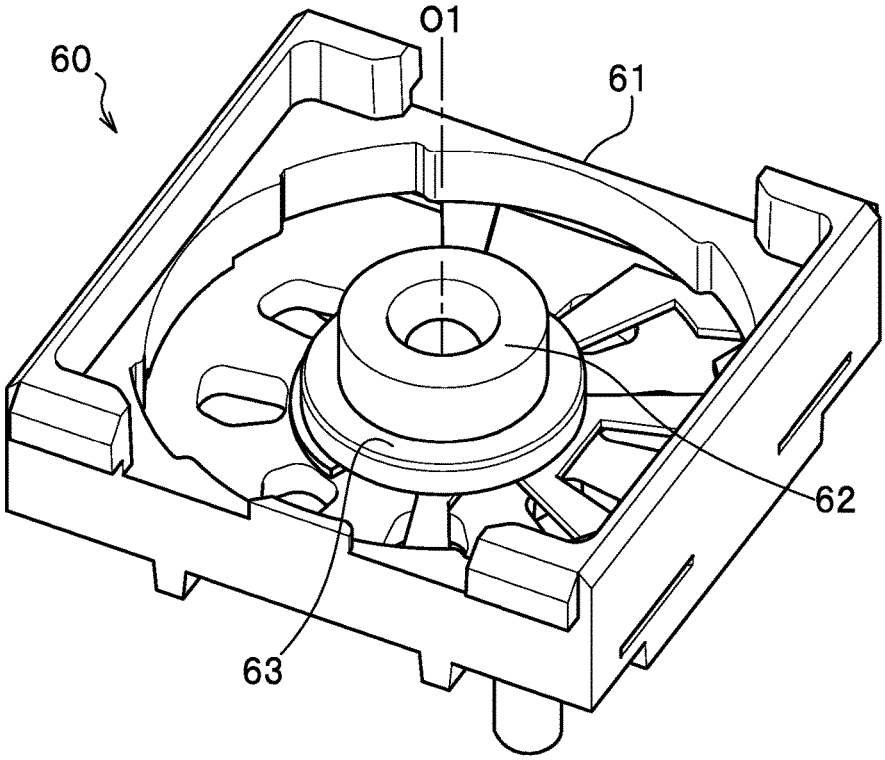
Figure 11:
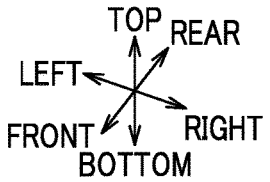
FIG. 11 is a perspective view of the fixed contact of FIG. 9.
Figure 11:
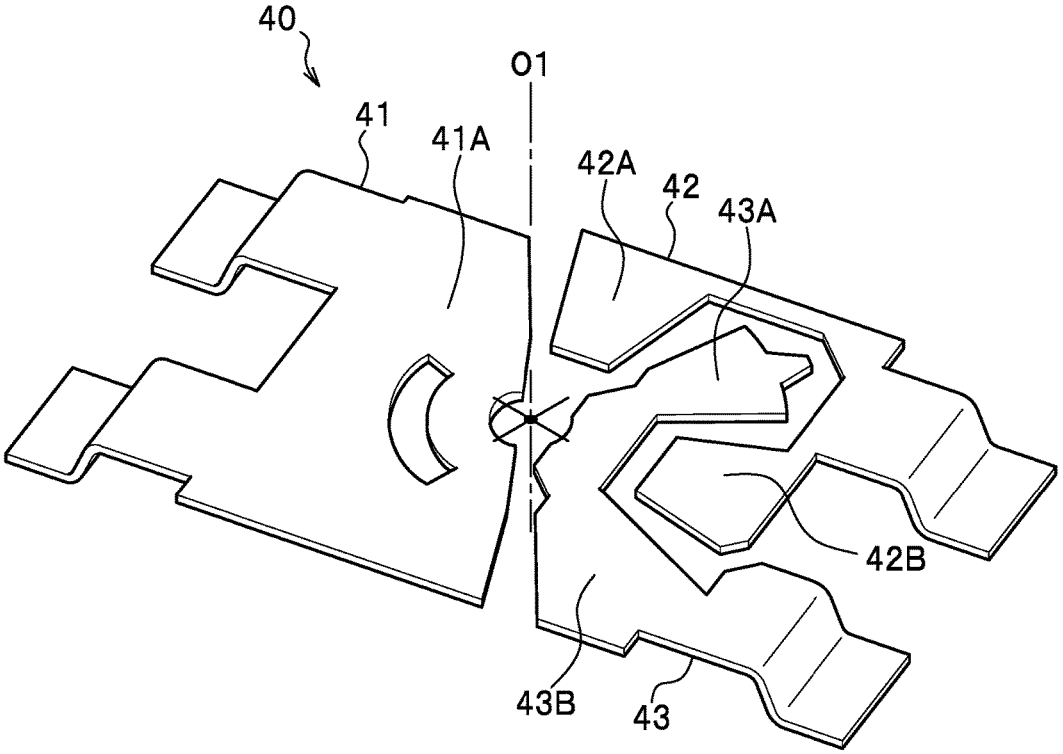

The fixed terminal 40 is, at a fixation side (non-rotation side), a terminal partially embedded in the base 60 (see FIGS. 9, 10, and 11). The fixed terminal 40 includes a first fixed terminal 41, a second fixed terminal 42, and a third fixed terminal 43. Each terminal is connected to an external circuit such a power source or a load. The first fixed terminal 41, the second fixed terminal 42, and the third fixed terminal 43 are electrically energizable metallic members formed by pressing or the like a metallic thin plate.

The first fixed terminal 41 includes a first A fixed contact 41A exposed upward from the base 60. The first A contact 41A is formed in a semicircle about the axis O1 with a central angle of approximately 170 degrees. Thereby, even if the contact member 30 is disposed at any angular positions in the circumferential direction, one of the two movable contacts 32*a* spaced at 180 degrees interval contacts with the first A fixed contact 41A.

The second fixed terminal 42 includes a second A fixed contact 42A and a second B fixed contact 42B each exposed upward from the base 60. The second A fixed terminal 42A and the second B fixed terminal 42B each represent a sector about the axis O1 with an central angle of approximately 40 degrees.

The third fixed terminal 43 includes a third A fixed terminal 43A and a third B fixed terminal 43B each exposed upward from the base 60. The third A fixed contact 43A and the third B fixed contact 43B each represent a sector about the axis O1 with an central angle of approximately 40 degrees.

In a planar view, the first A fixed contact 41A, the second A contact 42A, the third A fixed contact 43A, the second B fixed contact 42B, and the third B fixed contact 43B are arranged in order in the circumferential direction about the axis O1. Accordingly, when the contact member 30 rotates about the axis O1 by every 45 degrees, the two movable contacts 32*a* are switched to "a first position→a second position→a third position→a fourth position→the first position→ . . . " in order.

At the first position, the movable contacts 32*a* contacts with the first A fixed contact 41A and the second A fixed contact 42A respectively, and thereby the first A fixed contact 41A and the second A fixed contact 42A are electrically connected to each other.

At the second position, the movable contacts 32*a* contact with the first A fixed contact 41A and the third A fixed contact 43A respectively, and the first A fixed contact 41A and the third A fixed contact 43A are electrically connected to each other.

At the third position, the movable contacts 32*a* contact with the first A fixed contact 41A and the second B fixed contact 42B respectively, and the first A fixed contact 41A and the second B fixed contact 42B are electrically connected to each other.

At the fourth position, the movable contacts 32*a* contact with the first A fixed contact 41A and the third B fixed contact 43B respectively, and the first A fixed contact 41A and the third B fixed contact 43B are electrically connected to each other.

<Housing>

The housing 50 is a cylindrical case of a hollow structure, and includes a columnar hollow part 51 inside thereof (see FIGS. 3, 4, 5, 6, and 12A through 12J). The hollow part 51 has a space in which the operation button 10, the cam follower 20 and the like are housed. The housing 50 enclosing the hollow part 51 has an inner circumferential surface 52, on which guide parts 53 are formed to guide up and down movement (rising and lowering movement) of the operation button 10 and the rising and lowering movement (up and down movement) and rotation movement of the cam follower 20. Note the lower portion of the hosing 50 is partially inserted in the base 60 described below.

<Housing—Guide Part>

The guide part 53 includes four rotation restriction parts 54 and four return restriction parts 55, and four introduction parts 56 (see FIGS. 4, 6, and 12). The four rotation restriction parts 54 are arranged at equal angular intervals (90 degrees interval) in the circumferential direction. Between the rotation restriction parts 54 neighboring to each other in the circumferential direction, a return restriction part 55 and an introduction part 56 are arranged in order. Note that, in a plane view, a rotation restriction part 54, the return restriction part 55, and the introduction part 56 are arranged clockwise in order.

The rotation restriction parts 54 are each constructed with a vertical groove which extends in the vertical direction (up-down direction), whose lower end is open, and whose upper is closed. In the rotation restriction parts 54, the guided parts 13 of the operation button 10 are housed slidably in the axial direction. Thereby, the operation button 10 is guided by the rotation restriction parts 54 in the axial direction, while being restricted from rotating about the axis O1 by the rotation restriction parts 54.

When the cam part 26 of the cam follower 20 is housed in the rotation restriction part 54, the cam follower 20 is guided by the rotation restriction parts 54 in the axial direction, while being restricted from rotating about the axis O1 by the rotation restriction part 54. Namely, when the cam part 26 is housed in the rotation restriction part 54, the cam follower 20 comes into a "return allowed state" under which the cam follower 20 is allowed to return upward (see FIG. 12A).

The return restriction part 55 and the introduction part 56 are recessed parts (cut-off parts) formed by recessing partially the lower portion of the inner circumference of the cylindrical housing 50 in the radially outer ward direction.

The return restriction part 55 is a part to restrict the cam part 26 from moving upward and rotating. The return restriction part 55 includes a top wall surface 55*a* inclining upward as coming apart from the rotation restriction part 54 in the circumferential direction; and a side wall surface 55*b* extending downward from the top most portion of the top wall surface.

When the cam part 26 is disposed at the corner part 55*c* of the top wall surface 55*a* and the side wall surface 55*b*, the cam part 26 is locked (or stopped) in the axial direction and comes into a "return restriction state" under which the cam follower 20 is restricted from returning upward. Namely, in the "return restriction state", the cam follower 20 is kept pressed downward. At the same time, the cam part 26 is locked (or stopped) in the circumferential direction, and the cam follower 20 is restricted from rotating. Note that the corner part 55*c* is disposed at the approximate intermediate between the rotation restriction parts 54 in the circumferential direction.

The introduction part 56 guides and introduces, to the rotation restriction part 54, the cam part 26 which is released downward from the return restriction part 55 by the push operation. The introduction part 56 includes an introduction surface 56*a* inclining upward from the side wall surface 55*b* toward the rotation restriction part 54.

<Base>

The base 60 is a resinous member forming a support of the push switch 1. The base 60 includes a base body 61, a rotation axis part 62, and a pedestal part 63 (see FIGS. 5, 9, and 10).

The base body 61 represents a shallow square-box shape with the upper opened. Inside of base body 61, the first fixed terminal 41, the second fixed terminal 42, and the third fixed terminal 43 are partially molded.

The rotation axis part 62 is a cylindrical part extending upward from the center of the bottom wall portion of the base body 61 along the axis O1. The rotation axis part 62 extends through the through-hole 31*a* of the base part 31, and serves as a rotation center of the contact member 30 (see FIG. 3). In such a way, the contact member 30 stably rotates about the rotation axis part 62 without inclining. Note that the inclined contact member 30 may cause a contact defect without smoothly rotating.

The upper end portion of the rotation axis part 62 is also inserted in the lower portion of the first spring 70 (see FIG. 3). This prevents the first spring 70 from inclining, and the first spring 70 preferably urges the cam follower 20 upward. Note that, if the first spring inclines, the urging direction of the first spring 70 is off the direction of the axis O1, which makes it difficult for the cam follower 20 to rotate smoothly.

The pedestal part 63 projects upward (contact member 30 side) of the first A fixed contact 41A, the second A contact 42A, the second B fixed contact 42B, the third A fixed contact 43A, and the third B fixed contact 43B. The pedestal part 63 slidably contacts with the base part 31, and prevents unnecessary short-circuit of the contact member 30 and the first A fixed contact 41A and the like. Thereby, the contact member 30, urged downward by the first spring 70, does not contact with the fixed contact 40 except for the two movable contacts 32*a*.

<First Spring>

The first spring 70 is constructed of a compressed coil spring, and shrunkly disposed between the top wall part 23 of the cam follower 20 and the base part 31 of the contact member 30 (see FIG. 3). The first spring 70 urges the cam follower 20 upward (return direction) so as to mesh the first ratchet tooth 15 and the second ratchet tooth 27 with each other.

<Second Spring>

The second spring 80 is constructed of a compressed coil spring, and shrunkly disposed between the operation part 11 of the operation button 10 and the bottom wall part 21 of the cam follower 20 (see FIG. 3). The second spring 80 normally urges the operation button 10 upward relative to the cam follower 20. Thereby, without the push operation, the guided part 13 of the operation button 10 normally hooks on the housing 50. Thereby, the operation button 10 does not vibrate in the axial direction, the operation button 10 does not collide against the housing 50 repeatedly, and the collision noise does not occur.

<Cover>

The cover 90 has a reversed U-shape in a vertical section view. The cover 90 covers the housing 50, and the lower end portion of the cover 90 locks with the base 60. Thereby, the housing 50 and the base 60 are kept assembled together.

<Operation and benefit of Push Switch>

Figure 12A:
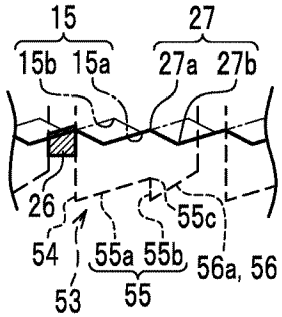
FIGS. 12A through 12J are development views indicating stepwise operation of the push switch of FIG. 1.
Figure 12B:
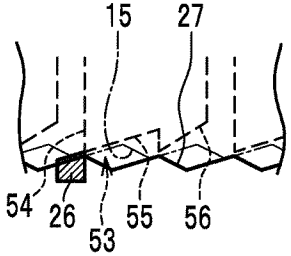

The operation of the push switch 1 is described with reference to FIGS. 12A through 12J. As illustrated in FIG. 12A, in the return allowance state under which the cam part 26 is disposed in the rotation restriction part 54, the push operation, or pushing down the operation button 10, makes the first ratchet tooth 15 push down the cam part 26.

Figure 12C:
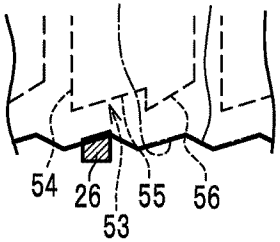
Figure 12D:
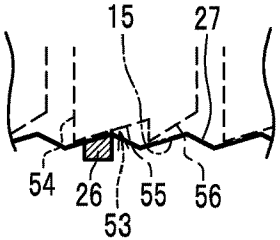
Figure 12E:
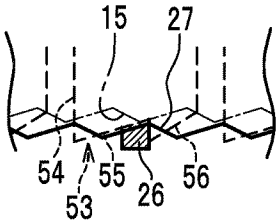

When the cam part 26 is pushed down below the rotation restriction part 54 (see FIG. 12B), the cam part 26 slides along the first ratchet tooth 15 and the cam follower 20 rotates (see FIG. 12C).

When the push operation is released, the first ratchet tooth 15 of the operation button 10 moves up. Meanwhile, the cam part 26 slides along the top wall surface 55*a* of the return restriction part 55 (see FIG. 12D). The cam part 26 locks with the corner part 55*c*, resulting in a return restriction state under which the cam follower 20 is restricted from returning upward and rotating (see FIG. 12E).

Figure 12F:
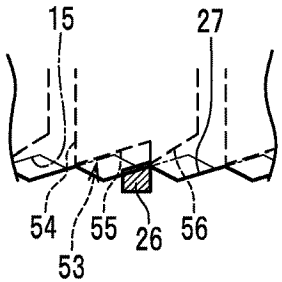
Figure 12G:
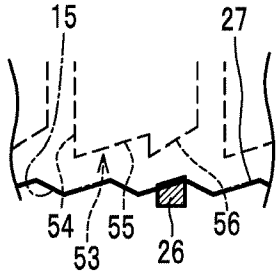
Figure 12H:
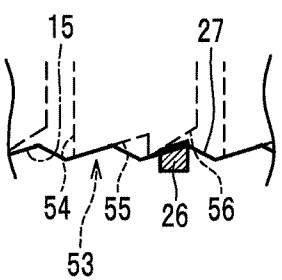
Figure 12I:
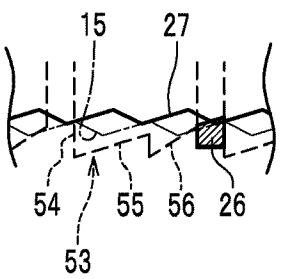
Figure 12J:
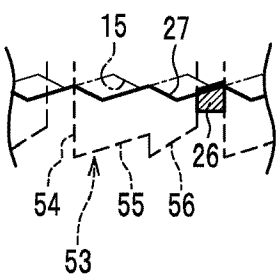

In the return restriction state, the push operation makes the first ratchet tooth 15 push down the cam part 26 (see FIG. 12F). When the cam part 26 is pushed down below the return restriction part 55, the cam part 26 slides along the first ratchet tooth 15 and the cam follower 20 rotates (see FIG. 12G).

When the push operation is released, the first ratchet tooth 15 of the operation button 10 moves up. Meanwhile, the cam part 26 slides along the introduction surface 56*a* (see FIG. 12H) to be introduced into the rotation restriction part 54 (see FIG. 12I). Then, the cam part 26 moves up in the rotation restriction part 54 to return into the return allowance state (see FIG. 12 J).

Herein, the rotation restriction parts 54 are at angular intervals of 90 degrees in the circumferential direction, and the corner parts 55*c* are disposed at the approximate intermediate between the neighboring rotation restriction parts 54 in the circumferential direction respectively. Thereby, the cam parts 26 (cam follower 20) rotate with the push operation by every approximately 45 degrees. The contact member 30 integrated with the cam follower 20 also rotates with the push operation by every approximately 45 degrees. The position of the movable contact 32*a* is switched to "the first position→the second position→the third position→the fourth position→the first position→ . . . " in order.

The contact member 30 functions as two components of the operation member and the movable contact in the Patent Document (1), and the number of components is reduced. The contact member 30 is rotatable about the rotation axis part 62 without inclining. In addition, the upper portion of the rotation axis part 62 is inserted in the first spring 70, and the first spring is prevented from falling down.

Though one embodiment of the invention is described above, the invention is not limited to the embodiment and may be appropriately modified.

Modifications and variations of the embodiments described above will occur to those skilled in the art, in light of the above teachings. The scope of the invention is defined with reference to the following claims.

This application is based upon and claims the benefit of priority from Japanese Patent Application No. 2016-032338 filed on Feb. 23, 2016; the entire contents of which are incorporated herein by reference.

The invention claimed is:

1. A push switch comprising:

a hollow housing having an inner circumferential surface formed with a guide part including a rotation restriction part and a return restriction part;

an operation button including a first ratchet tooth extending in a circumferential direction and being movable up and down in an axial direction;

a cam follower including a cam part configured to be guided to the rotation restriction part and the return restriction part; and a second ratchet tooth engaged with the first ratchet tooth, the cam follower being movable up and down in the axial direction and rotatable in the circumferential direction;

a first spring urging the cam follower to come close to the operation button in a return direction so as to mesh the first ratchet tooth and the second ratchet tooth with each other;

a contact member formed of a single metallic plate and including an engagement part engaged with the cam follower, and a movable contact, the contact member being configured to rotate integrally with the cam follower the engagement part and the movable contact both being formed by the single metallic plate and also being monolithic to one another;

a fixed contact configured to contact with the movable contact and including contacts to be switched by rotating the contact member; and a base on which the fixed contact is fixed, wherein, when the operation button is pushed in a return allowance state under which the cam part is disposed at the rotation restriction part, the cam part moves from the rotation restriction part to the return restriction part, wherein the cam follower and the cam contact member rotates before the cam part locks with the return restriction part to come into a return restriction state under which the cam follower is restricted from returning, wherein, when the operation button is pushed in the return restriction state, the cam part moves from the return restriction part to the rotation restriction part, wherein the cam follower and the contact member rotate before the cam part comes into the return allowance state, wherein the contact member has a rotation center and defines a through hole at the rotation center, and wherein the base includes a rotation axis part inserted in the through hole and serving as the rotation center of the contact member.

2. The push switch set forth in claim 1, wherein the rotation axis part includes an end inserted in the first spring constructed of a coil spring.

3. The push switch set forth in claim 1, wherein the base comprises an annular pedestal part projecting over the fixed contact toward the contact member.

4. The push switch set forth in claim 2, wherein the base comprises an annular pedestal part projecting over the fixed contact toward the contact member, wherein the pedestal part extends radially from the rotation axis part, wherein the pedestal part is lower than the rotation axis part, and wherein the contact member is placed on the pedestal part.

5. The push switch set forth in claim 1, wherein the contact member comprises a base part; and a tongue piece formed with the movable contact and extending obliquely downward from an outer periphery of the base part, wherein the engagement part extends upward from the base part, wherein the base part, the tongue piece, and the engagement part are formed by the single metallic plate, wherein the rotation axis part includes an end inserted in the first spring constructed of a coil spring, wherein the base comprises an annular pedestal part projecting over the fixed contact toward the contact member, wherein the pedestal part extends radially from the rotation axis part, wherein the pedestal part is lower than the rotation axis part, and wherein the base plate is placed on the pedestal part.

6. The push switch set forth in claim 5, wherein the tongue piece and the engagement part are arranged at 90 degree interval.

7. The push switch set forth in claim 1, wherein the cam follower comprises an outer cylinder part; and a flange part extending radially outward from a lower end of the outer cylinder part and formed with the second ratchet tooth, and wherein the cam part extends radially outward from an outer periphery of the flange part.

8. The push switch set forth in claim 7, wherein the flange part has an engagement hole in which the engagement part is movably inserted.

9. The push switch set forth in claim 8, wherein the engagement part comprises an upper end with a widened part, and wherein the widened part hooks on flange part.

* * * * *